US012765694B2

(12) United States Patent
Long

(10) Patent No.: US 12,765,694 B2
(45) Date of Patent: Oct. 20, 2026

(54) AIRBAG STRUCTURE, MATTRESS AND BED

(71) Applicant: GREE ELECTRIC APPLIANCES, INC. OF ZHUHAI, Zhuhai (CN)

(72) Inventor: Shicai Long, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 0 days.

(21) Appl. No.: 18/795,650

(22) Filed: Aug. 6, 2024

(65) Prior Publication Data

US 2024/0389764 A1 Nov. 28, 2024

Related U.S. Application Data

(63) Continuation of application No. PCT/CN2022/139897, filed on Dec. 19, 2022.

(30) Foreign Application Priority Data

Mar. 17, 2022 (CN) ..... 202210266036.9

(51) Int. Cl.
*A47C 27/08* (2006.01)
*A47C 27/10* (2006.01)

(52) U.S. Cl.
CPC ..... *A47C 27/087* (2013.01); *A47C 27/081* (2013.01); *A47C 27/10* (2013.01); *A47C 27/08* (2013.01)

(58) Field of Classification Search
CPC ..... A47C 27/087; A47C 27/081; A47C 27/08; A47C 27/10; A61G 7/05769; A61G 7/05776
USPC ..... 5/706, 710, 713, 644, 654, 655.3
See application file for complete search history.

(56) References Cited

U.S. PATENT DOCUMENTS 4,042,988 A * 8/1977 Holliday ..... A47C 27/081 5/691
4,934,002 A 6/1990 Watanabe
5,421,044 A * 6/1995 Steensen ..... A47C 27/18 5/713
5,634,224 A * 6/1997 Gates ..... A47C 27/081 5/709

(Continued)

FOREIGN PATENT DOCUMENTS

CN 2403399 Y 11/2000
CN 209713464 U 12/2019

(Continued)

OTHER PUBLICATIONS

First Office Action issued in counterpart Chinese Patent Application No. 202210266036.9, dated Apr. 16, 2025.

(Continued)

*Primary Examiner* — Robert G Santos
(74) *Attorney, Agent, or Firm* — Westbridge IP LLC

(57) ABSTRACT

An airbag structure includes a supporting component, and an airbag component. The airbag component includes a plurality of airbags and a first fixing strap, each of the plurality of airbag is provided with a second fixing strap, the second fixing strap is connected to the first fixing strap, and the first fixing strap is connected to the supporting component. This airbag structure solves a problem of poor stability and consistency of airbags.

20 Claims, 3 Drawing Sheets

(56) References Cited

U.S. PATENT DOCUMENTS

| | | | | | |
|---|---|---|---|---|---|
| 5,966,762 | A * | 10/1999 | Wu | A61G 7/05769 | 5/713 |
| 6,148,461 | A * | 11/2000 | Cook | A61G 7/05792 | 5/713 |
| 6,671,912 | B1 * | 1/2004 | Tsai | A61G 7/05776 | 5/713 |
| 7,086,104 | B1 * | 8/2006 | Tsay | A61G 5/1045 | 5/713 |
| 7,107,640 | B2 * | 9/2006 | Chapman | A61G 7/05776 | 5/713 |
| 7,913,338 | B2 * | 3/2011 | Chapman | A61G 7/05776 | 5/710 |
| 2002/0133882 | A1 * | 9/2002 | Chapman | A61G 7/05776 | 5/713 |
| 2006/0253992 | A1 * | 11/2006 | Chapman | A61G 7/05776 | 5/713 |
| 2011/0296622 | A1 | 12/2011 | Hsu | | |
| 2024/0389764 | A1 * | 11/2024 | Long | A47C 27/081 | |

FOREIGN PATENT DOCUMENTS

| | | | | |
|---|---|---|---|---|
| CN | 211984692 | U | 11/2020 | |
| CN | 215604471 | U | 1/2022 | |
| CN | 114010002 | A | 2/2022 | |
| CN | 114176360 | A | 3/2022 | |
| CN | 114176361 | A | 3/2022 | |
| CN | 114176362 | A | 3/2022 | |
| CN | 114680510 | A | 7/2022 | |
| CN | 217090125 | U | 8/2022 | |
| JP | 2006087820 | A | 4/2006 | |
| WO | WO-2023173861 | A1 * | 9/2023 | A47C 27/081 |

OTHER PUBLICATIONS

International Search Report and Written Opinion issued in corresponding PCT Application No. PCT/CN2022/139897, dated Mar. 17, 2023.

* cited by examiner

AIRBAG STRUCTURE, MATTRESS AND BED

CROSS-REFERENCE TO RELATED APPLICATIONS

The present application is a continuation of International Application No. PCT/CN2022/139897, filed on Dec. 19, 2022, which claims priority to Chinese Patent Application No. 202210266036.9 filed on Mar. 17, 2022. All of the aforementioned patent applications are hereby incorporated by reference in their entireties.

TECHNICAL FIELD

The present disclosure relates to the field of home product technologies, and in particular, to an airbag structure, a mattress and a bed.

BACKGROUND

With the improvement of people's living standards and the development of network technologies, a concept of smart home is becoming more and more mature. The smart home includes air conditioners, refrigerators, televisions, mobile phones, rice cookers, smart gateways, and other home appliances or smart home products. Smart home products are equipped with Wi-Fi modules, temperature and humidity sensors, and so on, which constitute an overall ecological environment of the smart home.

A bed, as the most core component in furniture, is also gradually developing and evolving towards intelligence. Modules such as smart Bluetooth modules and speakers are integrated into smart beds. It is one of hot functions of a current smart bed to attach an airbag component to achieve different functions.

Airbag components in smart beds are mainly categorized into several types. Airbags with a first type are arranged individually, the airbags are spaced apart from each other without affecting each other, and such airbags are relatively simple in function and low in innovation. Airbags with a second type are stacked to achieve an effect of pushing and stroking function, the airbags have relatively more functions, but the stability in motion and consistency of the airbags are poor.

In summary, the current airbag components have the following problems: the stability between the airbags is poor, and consistency of action of the airbags is not good.

SUMMARY

The present disclosure provides an airbag structure, a mattress and a bed to solve the problem of poor stability and consistency of airbags in a related art.

According to a first aspect of the present disclosure, an airbag structure is provided, which includes a supporting component and an airbag component. The airbag component includes a plurality of airbags and a first fixing strap, each of the plurality of airbags is provided with a second fixing strap, the second fixing strap is connected to the first fixing strap, and the first fixing strap is connected to the supporting component.

Further, the second fixing strap is connected to the airbag by welding, the second fixing strap is connected to the first fixing strap by welding, and the first fixing strap is bonded to the airbag component by means of adhesive; or, the second fixing strap is connected to the airbag by welding, and the second fixing strap is connected to the first fixing strap by welding; or, the second fixing strap is connected to the airbag by welding, and the first fixing strap is bonded to the airbag component by means of adhesive; or, the second fixing strap is connected to the first fixing strap by welding, and the first fixing strap is bonded to the airbag component by means of adhesive; or, the second fixing strap is connected to the airbag by welding; or, the second fixing strap is connected to the first fixing strap by welding; or, the first fixing strap is bonded to the airbag component by means of adhesive.

Further, the airbag includes a first airbag and a second airbag connected to and communicated with the first airbag. The first airbag is located above the second airbag, and the second fixing strap is connected to the second airbag. The plurality of airbags are arranged in sequence along an extension direction of the first fixing strap.

Further, first airbags of two adjacent airbags are connected to each other.

Further, a first connection part and a second connection part are provided on an upper surface of the second airbag. The first connection part and the second connection part are arranged in sequence along an extension direction of the second fixing strap. The second fixing strap is connected to the first connection part, and the second fixing strap is connected to the second connection part.

Further, a part airbag of one airbag of two adjacent airbags is superimposed on a part airbag of the other airbag of the two adjacent airbags.

Further, the airbag component includes two first fixing straps, the two first fixing straps are arranged at intervals. A first end of the second fixing strap is connected to one first fixing strap of the two first fixing straps, and a second end of the second fixing strap is connected to the other first fixing strap of the two first fixing straps.

Further, the airbag structure includes a plurality of the airbag components, and the plurality of the airbag components are arranged on the supporting component at intervals.

Further, the supporting component further includes a first supporting member, a second supporting member and an air pipe. The second supporting member covers the first supporting member, and the air pipe is disposed on the first supporting member and is located between the first supporting member and the second supporting member. The second supporting member has an avoidance hole, and the air pipe is communicated with the airbags via the avoidance hole.

According to a second aspect of the present disclosure, a mattress is provided, the mattress includes an airbag structure, and the airbag structure is the aforementioned airbag structure.

According to a third aspect of the present disclosure, a bed is provided. The bed includes a bedstead and a mattress disposed on the bedstead, and the mattress is the aforementioned mattress.

The airbag structure of the present disclosure includes a supporting component and an airbag component. The airbag component includes a plurality of airbags and a first fixing strap, and the plurality of airbags are connected to the first fixing strap in sequence. Each airbag is provided with a second fixing strap, and the second fixing strap is fixedly connected to the airbag. Each second fixing strap is connected to the first fixing strap, and the first fixing strap is connected to the supporting component. This method of connection with each other makes the plurality of airbags form a complete component, that is the airbag component, and the airbag component as a whole is connected to the supporting component by the first fixing strap, thereby improving the stability and consistency of the airbag structure.

BRIEF DESCRIPTION OF THE DRAWINGS

In order to better illustrate technical solutions of embodiments of the present disclosure or a conventional art, the accompanying drawings that need to be used in the description of the embodiments or the conventional art are introduced briefly below. Obviously, the accompanying drawings described in follow are merely embodiments of the present disclosure, and a person of ordinary skill in the art can obtain other drawings based on the disclosed drawings without creative efforts.

DETAILED DESCRIPTION OF THE EMBODIMENTS

The technical solutions of the present disclosure are described clearly and completely in the following with reference to the accompanying drawings of the embodiments of the present disclosure. Obviously, the described embodiments are only a part of the embodiments of the present disclosure, and not all of the embodiments. Based on the embodiments of the present disclosure, all other embodiments obtained by a person of ordinary skill in the art without making creative efforts fall within the protection scope of the present disclosure.

It should be noted that the embodiments in the present disclosure and the features in the embodiments can be combined with each other without conflict. The present disclosure is described in detail in reference to the accompanying drawings and in conjunction with the embodiments.

It should be noted that the following detailed description is exemplary and is intended to provide further explanation of the present disclosure. Unless otherwise indicated, all technical and scientific terms used herein have the same meaning as those commonly understood by a person of ordinary skill in the art within the field of the present disclosure.

It should be noted that the terms used herein are only to describe specific implementations and are not intended to limit the exemplary implementations of the present disclosure. As used here, unless the context clearly indicates otherwise, the singular form described herein is also intended to include the plural form. In addition, it should be understood that when the terms "contains" and/or "includes" are used in this specification, and they refer to the presence of features, steps, operations, devices, components and/or combinations thereof.

Figure 1:
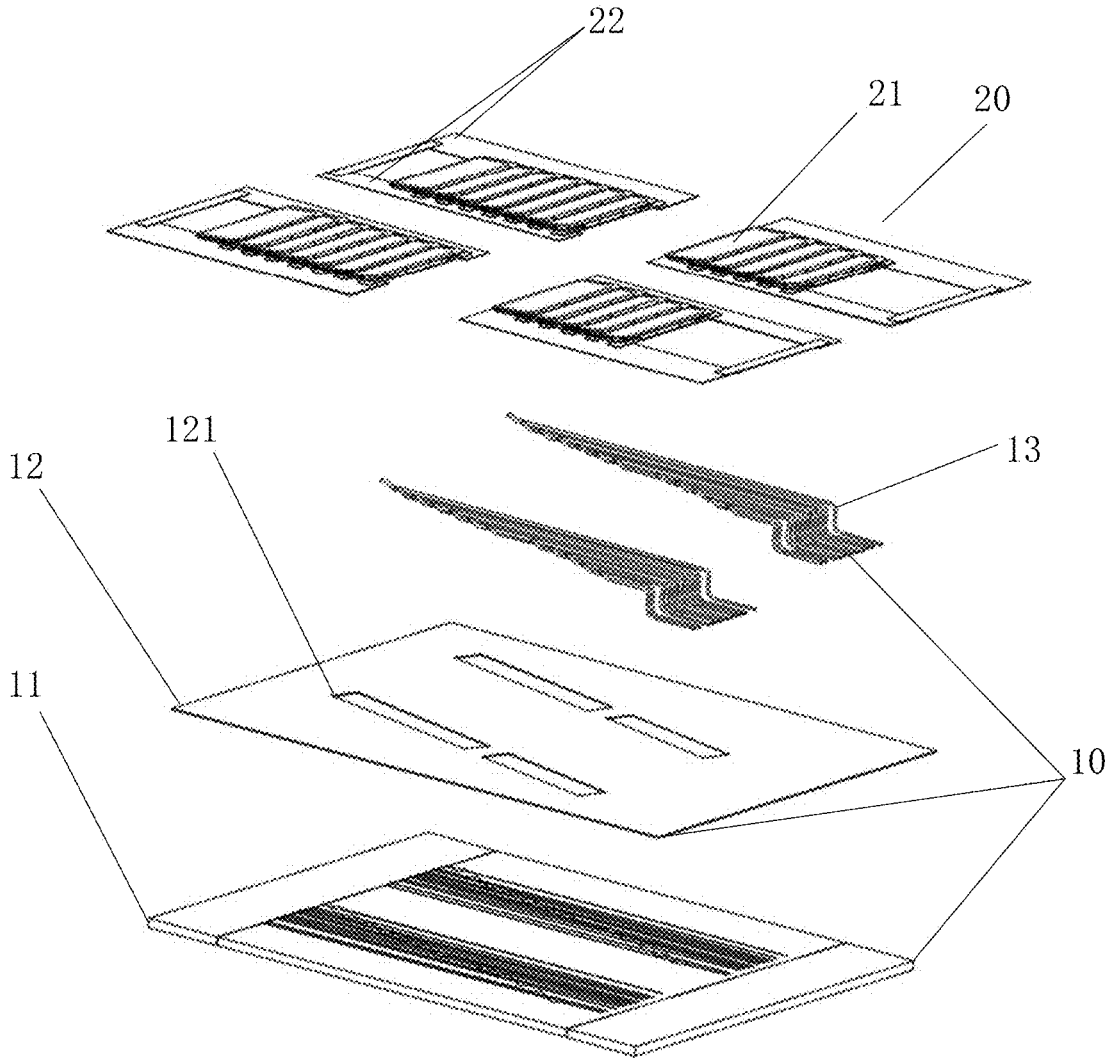
FIG. 1 is an exploded view of an airbag structure according to an embodiment of the present disclosure.
Figure 2:
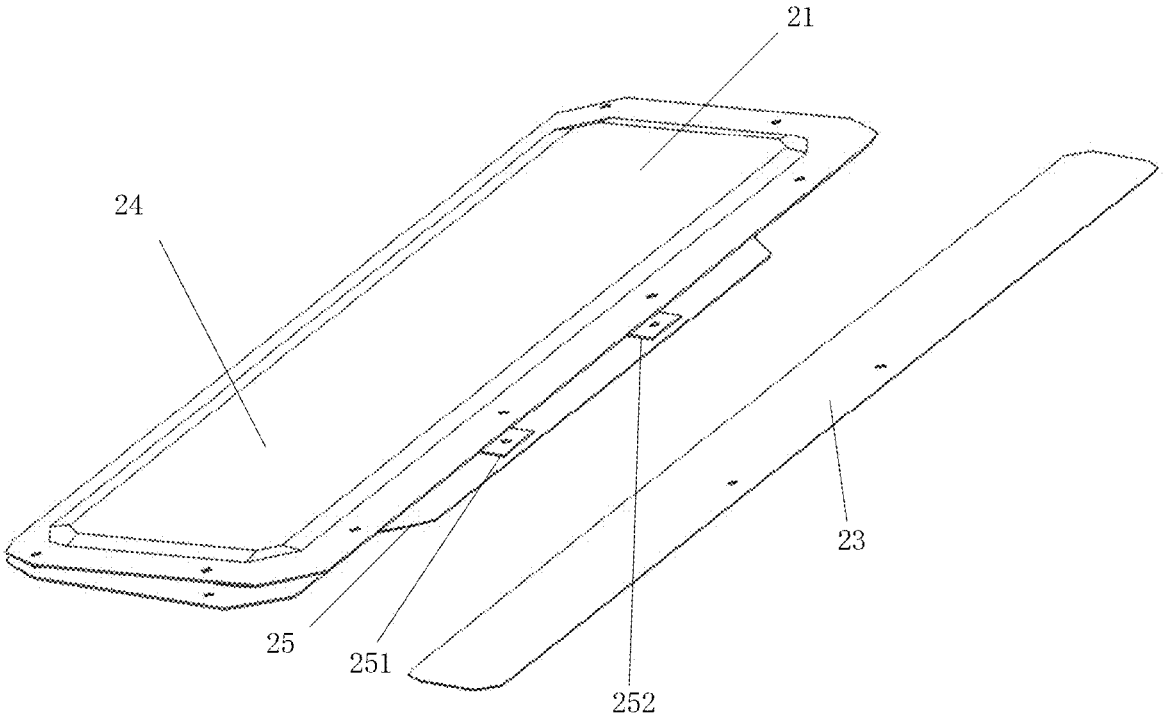
FIG. 2 is an exploded view of an airbag of an airbag structure according to an embodiment of the present disclosure.
Figure 3:
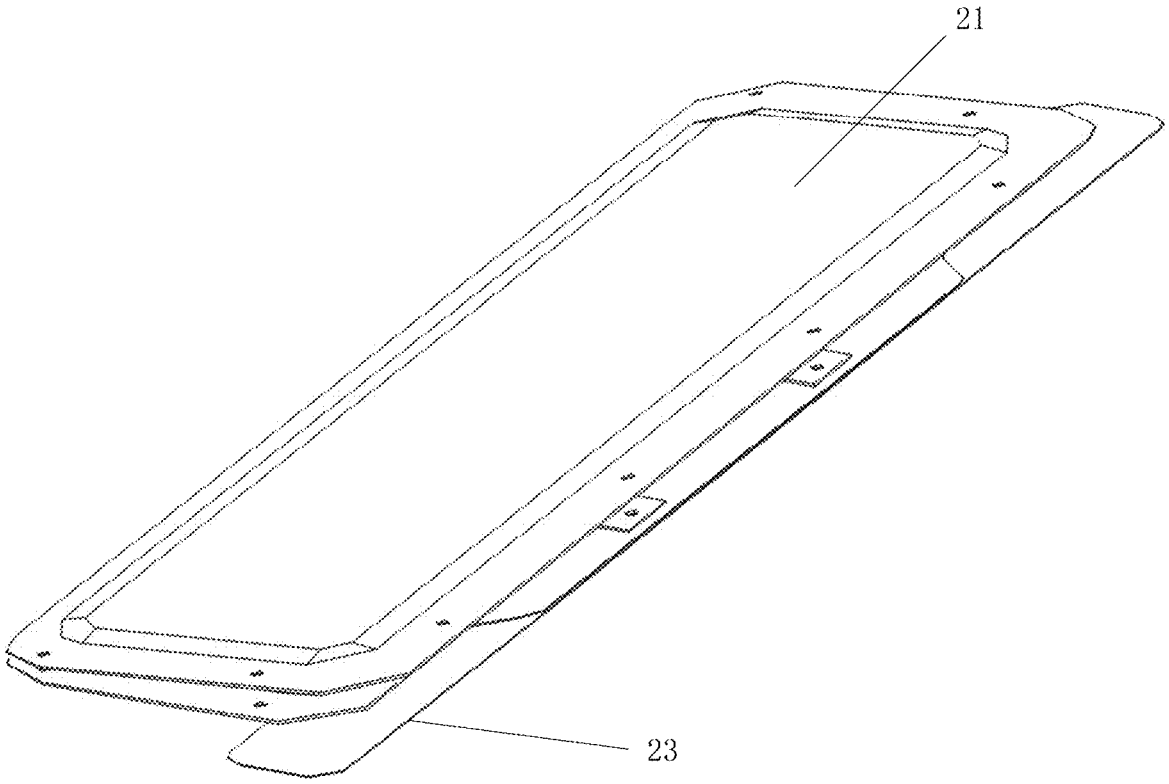
FIG. 3 is a schematic structural diagram of an airbag of an airbag structure according to an embodiment of the present disclosure.

In order to solve the problem of poor stability and consistency of current airbags, the present disclosure provides an airbag structure. Referring to FIGS. 1 to 3, the airbag structure includes: a supporting component 10; and an airbag component 20. The airbag component 20 includes a plurality of airbags 21 and a first fixing strap 22, each airbag 21 is provided with a second fixing strap 23, and each second fixing strap 23 is connected to the first fixing strap 22. The first fixing strap 22 is connected to the supporting component 10.

The airbag structure of the present disclosure includes a supporting component 10 and an airbag component 20. The airbag component 20 includes a plurality of airbags 21 and a first fixing strap 22. The plurality of airbags 21 are connected to the first fixing strap 22 in sequence. Each of the airbags 21 is provided with a second fixing strap 23, and the second fixing strap 23 is fixedly connected to the airbag 21. Each second fixing strap 23 is connected to the first fixing strap 22, and the first fixing strap 22 is connected to the supporting component 10. This method of connection with each other makes the plurality of airbags 21 form a complete component, that is the airbag component 20, and the airbag component 20 as a whole is connected to the supporting component 10 by the first fixing strap 22, thereby improving the stability and consistency of the airbag structure.

In some embodiments, as shown in FIG. 1, the second fixing strap 23 is connected to the airbag 21 by welding; and/or, the second fixing strap 23 is connected to the first fixing strap 22 by welding; and/or, the first fixing strap 22 is connected to the airbag component 20 by means of adhesive. The use of welding to form a component simplifies the manufacturing process. The use of bonding facilitates connection and simplifies the manufacturing process.

Specifically, the first fixing strap 22 is a strip-like structure and is fixedly connected to the airbag 21 by welding. The second fixing strap 23 is a strip-like structure with a length greater than that of the airbag 21. In order to make the airbag 21 more stably connected to the first fixing strap 22, a plurality of second fixing straps 23 are fixedly connected to the first fixing strap 22.

In some embodiments, as shown in FIG. 2, the airbag 21 includes a first airbag 24 and a second airbag 25 connected to and communicated with the first airbag 24, the first airbag 24 is located above the second airbag 25, and the second fixing strap 23 is connected to the second airbag 25. A plurality of airbags 21 are arranged in sequence along an extension direction of the first fixing strap 22.

In some embodiments, the first airbags 24 of two adjacent airbags 21 are connected to each other.

In a detailed implementation, the first airbag 24 is connected to the second airbag 25 located below it and has the same shape as the second airbag 25 located below it, which forms a whole structure. Moreover, the first airbags 24 of two adjacent airbags 21 are connected to each other, and each second airbag 25 is connected to the first fixing strap 22 by the second fixing strap 23, so that the plurality of airbags 21 have strong stability between each other, and have good consistency when the airbag component 20 acts.

In some embodiments, as shown in FIG. 2, a first connection part 251 and a second connection part 252 are provided on an upper surface of the second airbag 25, and the first connection part 251 and the second connection part 252 are arranged in sequence along an extension direction of the second fixing strap 23. The second fixing strap 23 is connected to the first connection part 251, and the second fixing strap 23 is connected to the second connection part 252.

In a detailed implementation, the arrangement of the first connection part 251 and the second connection part 252 effectively fixes the second fixing strap 23, so that the second fixing strap 23 is evenly stressed, and there may be no disconnection of a connection part. In addition, the fixing method of welding makes the connection more stable. Under the connection of the second fixing strap 23, the airbag 21 presents a structural form as shown in FIG. 3.

Specifically, the first connection part 251 and the second connection part 252 are both square structures. The first connection part 251 and the second connection part 252 are both arranged on the upper surface of the second airbag 25 and are both located at a marginal position of the upper surface. The first connection part 251 and the second connection part 252 are arranged at intervals.

In some embodiments, as shown in FIG. 1, a part of one airbag 21 of two adjacent airbags 21 is superimposed on a part of the other airbag 21 of the two adjacent airbags 21. Such an arrangement manner of the airbags 21 makes the front and rear airbags 21 contain each other, and the effect may be more continuous and smoother when implementing various pushing and stroking modes, without a sense of blocking.

Figure 4:
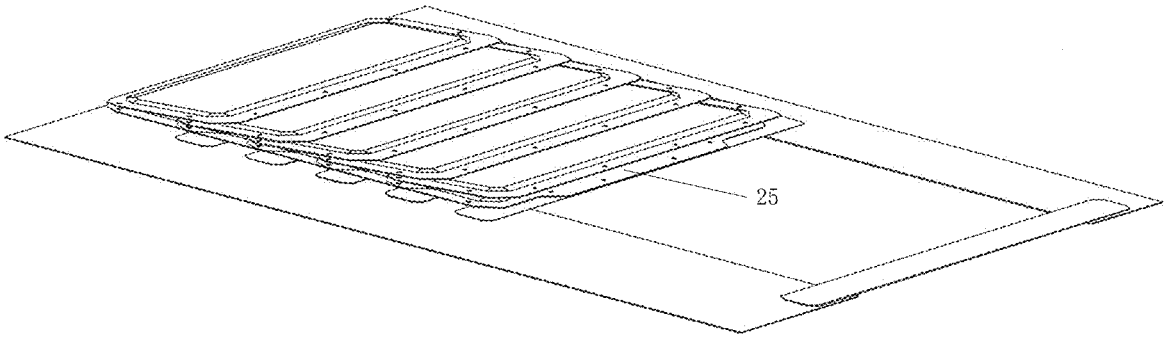
FIG. 4 is a schematic structural diagram of an airbag component according to an embodiment of the present disclosure.

In a detailed implementation, among the two adjacent airbags 21, the first airbag 24 of one airbag 21 is superimposed on the first airbag 24 of the next airbag 21, and the second airbag 25 of the next airbag 21 is superimposed on the second airbag 25 of the previous airbag 21, as shown in FIG. 4.

In some embodiments, as shown in FIG. 1, the airbag component 20 includes two first fixing straps 22, and the two first fixing straps 22 are arranged at intervals. A first end of the second fixing strap 23 is connected to one first fixing strap 22 of the two first fixing straps 22, and a second end of the second fixing strap 23 is connected to the other first fixing strap 22 of the two first fixing straps 22. This arrangement ensures that a plurality of airbags 21 of the airbag component 20 are reliably fixed and improves the stability and consistency of the airbag component 20.

Specifically, a spacing distance between the two first fixing straps 22 is adapted to a length of the airbag 21, the two first fixing straps 22 are arranged on both sides of a plurality of airbags 21, and the first fixing strap 22 and the second fixing strap 23 are connected by welding.

In some embodiments, as shown in FIG. 1, the airbag structure includes a plurality of airbag components 20, and the plurality of airbag components 20 are arranged on the supporting component 10 at intervals.

In a detailed implementation, the quantity of airbags 21 contained in each airbag component 20 may be different or the same.

Optionally, there are four airbag components 20, and among the four airbag components 20, two airbag components 20 each contain seven airbags 21, and the other two airbag components 20 each contain five airbags 21.

In some embodiments, the supporting component 10 further includes a first supporting member 11, a second supporting member 12 and an air pipe 13. The second supporting member 12 covers the first supporting member 11, and the air pipe 13 is disposed on the first supporting member 11 and is located between the first supporting member 11 and the second supporting member 12. The second supporting member 12 has an avoidance hole 121, and the air pipe 13 is communicated with the airbag 21 via the avoidance hole 121.

Specifically, the second supporting member 12 is made of PK cotton, which refers to hard cotton and has the characteristics of high air permeability, superior thermal insulation properties, firmness, no toxicity and no odor, etc.

In a detailed implementation, the first fixing strap of the airbag component 20 is fixed together with the second supporting member 12 by means of spray adhesive bonding. A shape of an outlet of the air pipe 13 is adapted to a shape of the avoidance hole 121, so that the gas is easily discharged from the air pipe 13. The avoidance hole 121 is arranged to avoid the air pipe 13.

The present disclosure further provides a mattress, which includes an airbag structure, and the airbag structure is the airbag structure in the aforementioned embodiments.

The present disclosure further provides a bed, which includes a bedstead and a mattress disposed on the bedstead, and the mattress is the mattress in the aforementioned embodiments.

The present disclosure solves the following technical problems:

At present, the arrangement configuration of airbags 21 is single, and the effect of various pushing and stroking is not obvious. The airbags 21 are independent from each other, there is no fixed connection between the airbags, the stability between the airbags is poor, and the consistency of action of the airbags 21 is not good. At present, the airbags 21 are connected by riveting, which wastes more working hours in production. In the embodiments of the present disclosure, components are connected by welding, which simplifies the manufacturing process and reduces the working hours.

The present disclosure further has the following beneficial effects.

The airbags 21 in the present disclosure are arranged in an inner and outer wrapping manner, the front and rear airbags 21 contain each other, and the effect may be more continuous and smoother when implementing various pushing and stroking modes, without a sense of blocking. The first airbags 24 in the upper layer are connected to each other, and the second airbags 25 in the lower layer are fixed on the first fixing strap. The first fixing strap is connected to the second supporting member 12 to realize the stability and reliability of the bottom layer. The aforementioned connection method not only makes the operation mode of the airbags 21 more continuous, but also improves the integrity, stability and consistency of the airbag component 20.

From the aforementioned description, it may be seen that the embodiments of the present disclosure achieve the following technical effects.

The airbag structure of the present disclosure includes a supporting component 10 and an airbag component 20. The airbag component 20 includes a plurality of airbags 21 and a first fixing strap 22. The plurality of airbags 21 are connected in sequence on the first fixing strap 22. Each airbag 21 is provided with a second fixing strap 23. The second fixing strap 23 is fixedly connected to the airbag 21, and each second fixing strap 23 is further connected to the first fixing strap 22. The first fixing strap 22 is connected to the supporting component 10. This method of connection with each other makes the plurality of airbags 21 form a complete component, that is the airbag component 20, and the airbag component 20 as a whole is connected to the supporting component 10 by the first fixing strap 22, thereby improving the stability and consistency of the airbag structure.

It should be noted that the terms "first", "second", etc., employed in the description, claims, and aforementioned drawings of the present disclosure are utilized to differentiate similar objects, rather than to denote a particular order or sequence. It should be understood that such designations can be freely interchanged under appropriate circumstances, so that the embodiments of the present disclosure described herein can be implemented in an order other than those illustrated or described herein. Moreover, the terms "includes" and "has" and any deformations thereof are intended to encompass non-exclusive inclusion. For example, a process, method, system, product, or device that includes a series of steps or units is not necessarily limited to those steps or units that are clearly listed, but may include other steps or units that are not clearly listed or inherent to such process, method, product, or device.

For ease of description, spatial relative terms such as "on", "above", "on an upper surface" "upper", may be used herein to describe a spatial position relationship between a device or feature and other device or feature as shown in the drawings. It should be understood that these spatial relative terms are intended to contain different orientations during usage or operation other than those orientations illustrated in the drawings for the device. For example, if the device as depicted in the drawings is inverted, a device described as being "above another device or structure" or "on another device or structure" may then be depicted "below another device or structure" or "under another device or structure". Hence, the exemplary term "above" may include both "above" and "below" orientations. The device may further be oriented in various other ways (e.g., rotated 90 degrees or in other orientations), and the spatial relative descriptions used herein is interpreted accordingly.

The technical features of the aforementioned embodiments can be combined arbitrarily. In order to simplify the description, it is not to describe all possible combinations of technical features in the aforementioned embodiments. However, as long as there is no contradiction in the combination of these technical features, the combination should be regarded as falling within the scope of the present disclosure.

The aforementioned embodiments merely exemplify several embodiments of the present disclosure, and their descriptions are more specific and detailed, but they cannot be understood as restrictions on the scope of the present disclosure. It should be pointed out that a person of ordinary skill in the art may make various modifications and enhancements without departing from the concept of the present disclosure, which are all within the protection scope of the present disclosure. Consequently, the scope of the present disclosure shall be subject to the appended claims.

What is claimed is:

1. An airbag structure, comprising:

a supporting component; and an airbag component, wherein the airbag component comprises a plurality of airbags and a first fixing strap, each of the plurality of airbags is provided with a second fixing strap, a plurality of second fixing straps corresponding to the plurality of airbags are connected to the first fixing strap, and are substantially perpendicular to the first fixing strap, and the first fixing strap is connected to the supporting component.

2. The airbag structure according to claim 1, wherein the second fixing strap is connected to the airbag by welding, the second fixing strap is connected to the first fixing strap by welding, and the first fixing strap is bonded to the airbag component by means of adhesive.

3. The airbag structure according to claim 1, wherein the second fixing strap is connected to the airbag by welding, and the second fixing strap is connected to the first fixing strap by welding.

4. The airbag structure according to claim 1, wherein the second fixing strap is connected to the airbag by welding, and the first fixing strap is bonded to the airbag component by means of adhesive.

5. The airbag structure according to claim 1, wherein the second fixing strap is connected to the first fixing strap by welding, and the first fixing strap is bonded to the airbag component by means of adhesive.

6. The airbag structure according to claim 1, wherein the second fixing strap is connected to the airbag by welding.

7. The airbag structure according to claim 1, wherein the second fixing strap is connected to the first fixing strap by welding.

8. The airbag structure according to claim 1, wherein the first fixing strap is bonded to the airbag component by means of adhesive.

9. The airbag structure according to claim 1, wherein each airbag comprises a first airbag and a second airbag connected to and communicated with the first airbag, the first airbag is located above the second airbag, the second fixing strap is connected to the second airbag, and the plurality of airbags are arranged in sequence along an extension direction of the first fixing strap.

10. The airbag structure according to claim 9, wherein first airbags of two adjacent airbags are connected to each other.

11. The airbag structure according to claim 9, wherein a first connection part and a second connection part are provided on an upper surface of the second airbag, the first connection part and the second connection part are arranged in sequence along an extension direction of the second fixing strap, the second fixing strap is connected to the first connection part, and the second fixing strap is connected to the second connection part.

12. The airbag structure according to claim 9, wherein a part of one airbag of two adjacent airbags is superimposed on a part of the other airbag of the two adjacent airbags.

13. The airbag structure according to claim 12, wherein a first airbag of one airbag of the two adjacent airbags is superimposed on a first airbag of the other airbag of the two adjacent airbags.

14. The airbag structure according to claim 1, wherein the airbag component comprises two first fixing straps, the two first fixing straps are arranged at intervals, a first end of the second fixing strap is connected to one first fixing strap of the two first fixing straps, and a second end of the second fixing strap is connected to the other first fixing strap of the two first fixing straps.

15. The airbag structure according to claim 1, wherein the airbag structure comprises a plurality of the airbag components, and the plurality of the airbag components are arranged on the supporting component at intervals.

16. The airbag structure according to claim 1, wherein the supporting component comprises a first supporting member, a second supporting member and an air pipe, the second supporting member covers the first supporting member, and the air pipe is disposed on the first supporting member and is located between the first supporting member and the second supporting member; and the second supporting member has an avoidance hole, and the air pipe is communicated with the airbag via the avoidance hole.

17. The airbag structure according to claim 16, wherein the first fixing strap of the airbag component is fixed together with the second supporting member.

18. A mattress, comprising an airbag structure, wherein the airbag structure comprises:

a supporting component; and an airbag component, wherein the airbag component comprises a plurality of airbags and a first fixing strap, each of the plurality of airbags is provided with a second fixing strap, a plurality of second fixing straps corresponding to the plurality of airbags are connected to the first fixing strap, and are substantially perpendicular to the first fixing strap, and the first fixing strap is connected to the supporting component.

19. The mattress according to claim 18, wherein the second fixing strap is connected to the airbag by welding, the second fixing strap is connected to the first fixing strap by welding, and the first fixing strap is bonded to the airbag component by means of adhesive.

20. A bed, comprising a bedstead and a mattress disposed on the bedstead, wherein the mattress comprises: an airbag structure, wherein the airbag structure comprises:

a supporting component; and an airbag component, wherein the airbag component comprises a plurality of airbags and a first fixing strap, each of the plurality of airbags is provided with a second fixing strap, a plurality of second fixing straps corresponding to the plurality of airbags are connected to the first fixing strap, and are substantially perpendicular to the first fixing strap, and the first fixing strap is connected to the supporting component.

* * * * *